US007712875B2

(12) United States Patent
Shibata et al.

(10) Patent No.: US 7,712,875 B2
(45) Date of Patent: May 11, 2010

(54) BASE MEMBER FOR LIQUID DISCHARGE HEAD, LIQUID DISCHARGE HEAD UTILIZING THE SAME, AND PRODUCING METHOD THEREFOR

(75) Inventors: Kazuaki Shibata, Kawasaki (JP); Takahiro Matsui, Yokohama (JP); Ichiro Saito, Yokohama (JP); Takuya Hatsui, Tokyo (JP); Sakai Yokoyama, Kawasaki (JP); Teruo Ozaki, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 209 days.

(21) Appl. No.: 11/769,352

(22) Filed: Jun. 27, 2007

(65) Prior Publication Data

US 2007/0242106 A1 Oct. 18, 2007

Related U.S. Application Data

(63) Continuation of application No. PCT/JP2007/055295, filed on Mar. 8, 2007.

(30) Foreign Application Priority Data

Mar. 10, 2006 (JP) ..... 2006-066346
Mar. 30, 2006 (JP) ..... 2006-093476
Mar. 30, 2006 (JP) ..... 2006-093670

(51) Int. Cl.
*B41J 2/05* (2006.01)

(52) U.S. Cl. ..... 347/56; 347/64

(58) Field of Classification Search ..... 347/45, 347/56, 63, 64
See application file for complete search history.

(56) References Cited

U.S. PATENT DOCUMENTS

| | | | | |
|---|---|---|---|---|
| 5,081,474 | A | 1/1992 | Shibata et al. | |
| 5,478,606 | A | 12/1995 | Ohkuma et al. | 427/555 |
| 5,491,505 | A | 2/1996 | Suzuki et al. | |
| 5,660,739 | A | 8/1997 | Ozaki et al. | 216/27 |
| 6,142,606 | A * | 11/2000 | Kubota et al. | 347/45 |
| 6,315,853 | B1 | 11/2001 | Kubota et al. | |
| 6,378,993 | B1 | 4/2002 | Ozaki et al. | |
| 6,435,660 | B1 * | 8/2002 | Ozaki et al. | 347/45 |
| 6,485,132 | B1 | 11/2002 | Hiroki et al. | |
| 2007/0120902 | A1 | 5/2007 | Ozaki et al. | |

FOREIGN PATENT DOCUMENTS

| | | |
|---|---|---|
| JP | 6-286149 | 10/1994 |
| JP | 8-112902 | 5/1996 |
| JP | 2006-056233 | 3/2006 |

* cited by examiner

*Primary Examiner*—An H Do
(74) *Attorney, Agent, or Firm*—Fitzpatrick, Cella, Harper & Scinto

(57) ABSTRACT

For providing a base for a liquid discharge head having an internal surface of a liquid flow path and a discharge port, suppressed in swelling by liquid and having high precision and high reliability, the base including a base member, an energy generating element for discharging a liquid, formed on the base member, and a resin structure having a liquid discharge port for discharging the liquid and disposed on the base member so as to cover the energy generating element, is provided with a protective layer. The protective layer is formed by a catalytic chemical vapor deposition on a surface of the resin structure in which the liquid discharge port is opened.

17 Claims, 12 Drawing Sheets

BASE MEMBER FOR LIQUID DISCHARGE HEAD, LIQUID DISCHARGE HEAD UTILIZING THE SAME, AND PRODUCING METHOD THEREFOR

This application is a continuation of International Application No. PCT/JP2007/055295, filed Mar. 8, 2007, which claims the benefit of Japanese Patent Application Nos. 2006-066346, filed Mar. 10, 2006, 2006-093476, filed Mar. 30, 2006, and 2006-093670, filed Mar. 30, 2006.

BACKGROUND OF THE INVENTION

1. Field of the Invention

The present invention relates to a base member for a liquid discharge head for discharging a liquid, a liquid discharge head utilizing the base member, and producing method therefor.

2. Description of the Related Art

A liquid discharge head for discharging a liquid from a liquid discharge port is used popularly, particularly as an ink jet head for use in an ink jet recording apparatus (ink jet printer). A producing method for such ink jet head is disclosed for example in Japanese Patent Application Laid-Open No. H06-286149.

In the ink jet head as an example of the liquid discharge head, a higher resolution of recording, a higher image quality and a higher speed are being recently requested. Among these requirements, a solving method for the requirements for higher resolution and higher image quality is proposed in making a smaller liquid amount of the discharged ink per dot (in case of discharging the ink as a droplet, making a smaller-sized droplet). In an ink jet head for discharging the ink by thermal energy as disclosed in the aforementioned patent reference, the smaller droplet size of the ink has been accomplished by reducing an area of a heat-generating part and by changing the shape of a nozzle (reducing the area of the ink discharge port).

In order to realize such smaller liquid droplet in the ink discharge amount, the ink discharge port has to be formed precisely. However, when a flow path forming member constituting an ink flow path wall and an ink discharge port is formed by a resinous material, as disclosed in Japanese Patent Application Laid-open No. H06-286149, the resinous material may exhibit a swelling by the ink or the like, thereby causing a deformation of the ink discharge port. In the past, such deformation has been minimal and has not been considered as a problem. However, in order to obtain an image of a higher quality with a higher speed, there is required a substrate for the ink jet head, bearing a plurality of discharge ports without such deformation.

Also the resinous material and the base member may become liable to show a peeling at the surface of the base member, resulting from the aforementioned deformation of the resinous material by the ink or from a deterioration caused by a chemical reaction with the ink component itself.

Also the flow path forming member, being formed by a photosensitive resin material, may cause a deformation by an unevenness in the exposure or by a reflection from an underlying layer, thereby becoming unable to precisely form the discharge port of a small area, corresponding to a small liquid droplet. Therefore, in order to form a discharge port matching a small liquid droplet and capable of reducing an ink mist, it is being investigated to utilize so-called dry etching technology such as reactive etching or plasma etching, instead of the photolithographic technology utilizing exposure and development of a photosensitive resin. More specifically, considered is a dry etching, utilizing an inorganic film such as a SiOC film, having a larger selectivity at etching in comparison with the flow path forming member, as a mask. However, since the conventional film forming method (for example plasma CVD) involves a high substrate temperature of from 200 to 300° C. or even higher at the film formation, the flow path forming member formed with a resinous material becomes deformed. Therefore, for executing an etching for forming the discharge port on the upper surface of the flow path forming member, a mask material has to be a material which can be formed at a low temperature that does not cause the deformation of the flow path forming member.

On the other hand, in order to obtain discharge characteristics capable realizing a further improved recording quality, it is desirable that the internal wall (internal surface) of the ink flow path is substantially hydrophilic, and that an external surface area of the flow path forming member, including the aperture of the ink discharge port, has a water-repellent property. Particularly in order to suppress a deformation in the ink discharge port, it is desirable to avoid a swelling, by the ink, of a surface in which the ink discharge port is opened (a discharge port-containing face of the ink jet head, opposed to a recording medium in the recording operation).

SUMMARY OF THE INVENTION

An object of the present invention is to provide a base member for a liquid discharge head, in which an internal surface of a liquid flow path and a discharge port are prevented from swelling by a liquid and are formed with a high precision and a high reliability, a liquid discharge head utilizing such base member and producing methods therefor.

Another object of the present invention is to provide a base member for a liquid discharge head, including a base member, an energy generating element for discharging a liquid, formed on the base member, and a resin structure having a liquid discharge port for discharging the liquid and disposed on the base member so as to cover the energy generating element, wherein a protective layer formed by a catalytic chemical vapor deposition is formed on a surface of the resin structure in which the liquid discharge port is opened.

Still another object of the present invention is to provide a producing method for a base member for liquid discharge head, including a base member, an energy generating element for discharging a liquid, formed on the base member, and a resin structure having a liquid discharge port for discharging the liquid and disposed on the base member so as to cover the energy generating element, the producing method including steps of forming a mold member in an area on the base member where a flow path is to be formed later, forming the resin structure so as to cover the mold member, forming a discharge port aperture protective layer which protects a surface of the resin structure where the liquid discharge port is formed by a catalytic chemical vapor deposition, forming an aperture in the discharge port aperture protective layer and in the resin structure from a position for forming the liquid discharge port to the mold member, and removing the mold member thereby forming the liquid path in the interior of the resin structure.

Further features of the present invention will become apparent from the following description of exemplary embodiments with reference to the attached drawings.

BRIEF DESCRIPTION OF THE DRAWINGS

FIGS. 2A and 2B are schematic cross-sectional views along a line X-X in FIG. 1, wherein FIG. 2B is a schematic magnified view of a portion indicated by a circle in FIG. 2A.

FIGS. 6A, 6B, 6C, 6D, 6E, 6F, 6G, 6H and 6I are schematic cross-sectional views illustrating a producing method for the ink jet head substrate in a first exemplary embodiment of the present invention, wherein FIGS. 6A, 6B, 6C, 6D, 6E, 6F, 6G and 6H are schematic cross-sectional views illustrating respective steps, while FIG. 6I is a schematic magnified view of a portion indicated by a circle in FIG. 6H.

FIGS. 7A, 7B and 7C are schematic magnified cross-sectional views illustrating the vicinity of an ink discharge port in a first exemplary embodiment of the present invention, wherein FIG. 7A is a schematic magnified cross-sectional view of the vicinity of the ink discharge port bearing a protective layer, FIG. 7B is a schematic magnified cross-sectional view of the vicinity of the ink discharge port, illustrating a modified layer formed by fluorine ion implantation into the protective layer illustrated in FIG. 7A, and FIG. 7C is a schematic magnified cross-sectional view of the vicinity of the ink discharge port, in which a water-repellent layer is formed on the protective layer illustrated in FIG. 7A.

FIGS. 8A, 8B, 8C, 8D, 8E, 8F, 8G, 8H, 8I, 8J and 8K are schematic cross-sectional views illustrating a producing method for an ink jet head substrate in a second exemplary embodiment of the present invention, wherein 8A, 8B, 8C, 8D, 8E, 8F, 8G, 8H, 8I and 8J are schematic cross-sectional views illustrating respective steps, while FIG. 8K is a schematic magnified view of a portion indicated by a circle in FIG. 8J.

FIGS. 9A, 9B, 9C, 9D, 9E, 9F, 9G, 9H, 9I, 9J and 9K are schematic cross-sectional views illustrating a producing method for an ink jet head substrate in a third exemplary embodiment of the present invention, wherein 9A, 9B, 9C, 9D, 9E, 9F, 9G, 9H, 9I and 9J are schematic cross-sectional views illustrating respective steps, while FIG. 9K is a schematic magnified view of a portion indicated by a circle in FIG. 9J.

DESCRIPTION OF THE EMBODIMENTS

In the following, exemplary embodiments of the present invention will be described, taking an ink jet head base member as an exemplary embodiment of the base member of liquid discharge head, and an ink jet head as an exemplary embodiment of the liquid discharge head.

Figure 1:
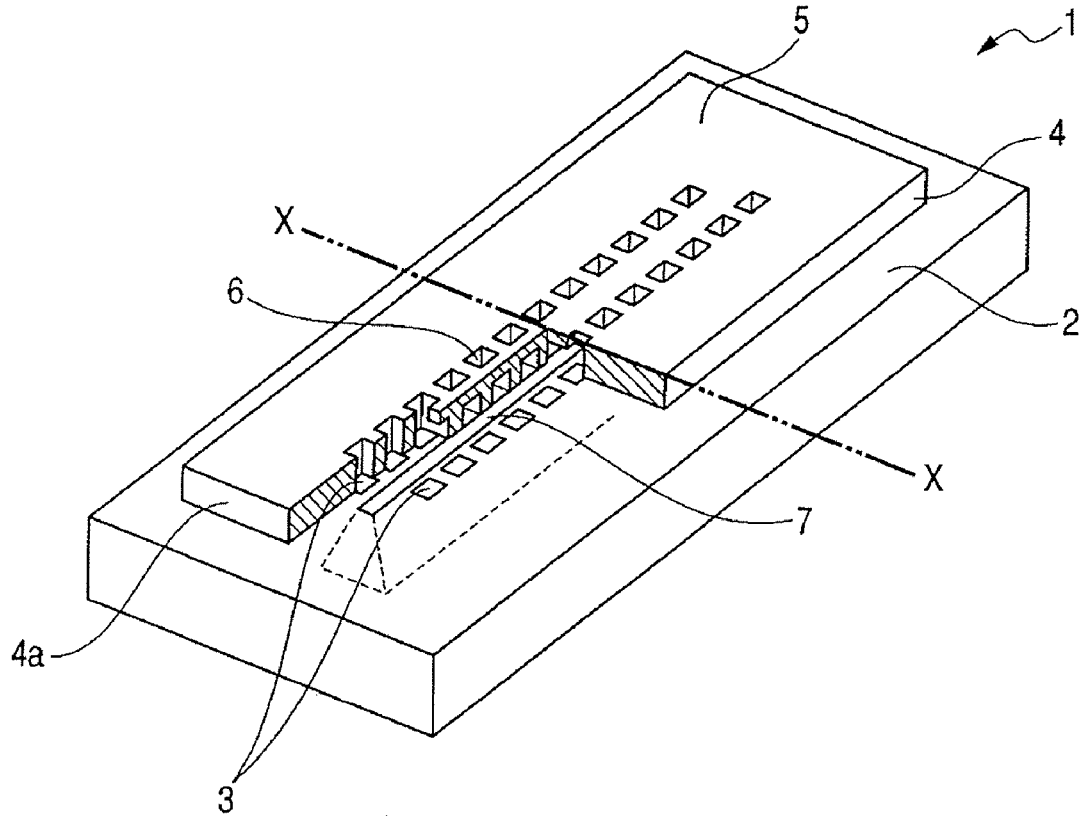
FIG. 1 is a partially cut-off schematic perspective view of an ink jet head substrate embodying the present invention.

FIG. 1 is a schematic perspective view, which is partially cut off in order to describe an ink jet head substrate 1. Illustrated are a silicon substrate 2, a heat generating part 3 for generating thermal energy (discharge energy) for liquid discharge from an ink discharge port 6 as a liquid discharge port, an ink supply opening 7 which penetrates through the silicon substrate 2 and is opened at the surface thereof, a discharge port-containing face 5 in which a plurality of ink discharge ports 6 are opened and which is opposed to a recording medium such as a recording paper when used as an ink jet head, and a flow path forming member 4 which is formed as a resin structure disposed on the surface of the silicon substrate 2 and in which an ink flow path 8 (cf. FIG. 2B) is formed from the ink supply opening 7 to the ink discharge port 6 through the position of the heat generating part 3.

Figure 2A:
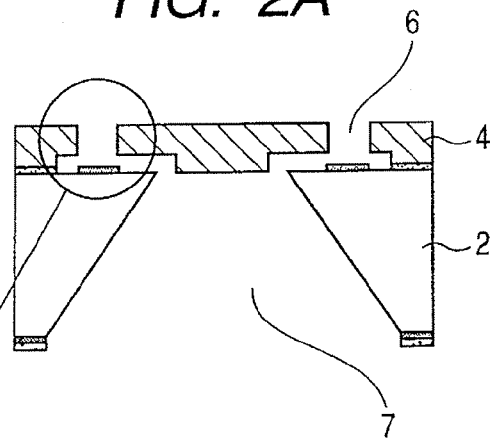
Figure 2B:
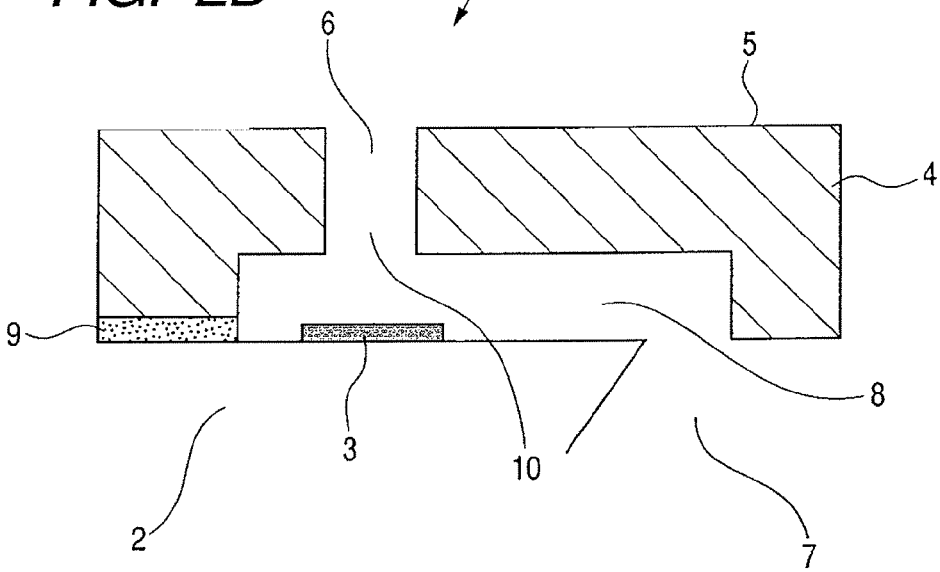

FIG. 2A is a schematic cross-sectional view along a line X-X in FIG. 1, and FIG. 2B is a view illustrating the vicinity of a portion indicated by a circle in FIG. 2A. Herein illustrated are an adhesion layer 9 for adjoining the silicon substrate 2 and the flow path forming member 4, and a flow path 10 in which the ink is supplied in an ink discharging direction at the ink discharge operation and which is called a discharge part. The discharge part 10 is a part of the ink flow path 8 and has the discharge port 6 at an end. Also the discharge part 10 is disposed in a such a position as to connect the heat generating part 3 and the ink discharge port 6 which are opposed with each other. The discharge port-containing face 5 is a surface of the flow path forming member 4, on which the discharge port 6 is opened. This surface is generally subjected to a water-repellent treatment in order to prevent a deposition of the ink, which is normally a liquid.

The ink jet head substrate 1 embodying the present invention has, in order to suppress a swelling of the resin structure (for example flow path forming member 4) which forms a flow path (for example ink flow path 8) for the liquid (for example ink), has a protective layer in at least one of following portions. This protective layer is formed by a catalytic chemical vapor deposition, which will be hereinafter represented as Cat-CVD process:

(1) a discharge port-containing face 5;

(2) an interface (adjoining surface or adjoining portion) between the silicon substrate 2 and the flow path forming member 4;

(3) an internal surface of the ink flow path 8 (part excluding internal surface of the ink flow path in the discharge part 10) formed in the flow path forming member 4;

(4) an internal surface of the ink flow path in the discharge part 10; and (5) an external lateral surface 4*a* of the flow path forming member 4.

In the case that a silicon-based protective layer formed by a Cat-CVD process is disposed in all of (1) to (5) above, the flow path forming member 4, in at least parts coming into contact with the ink, is covered by the protective layer formed by Cat-CVD process. As a result, the flow path forming member 4 does not contact the ink. However, even in case of forming the protective layer by Cat-CVD process only in a part of (1) to (5), following effects can be obtained respectively.

Firstly, the part (1) above significantly affects the ink discharge characteristics (for example a discharge direction of ink droplet).

The discharge port-containing face 5 preferably has a water-repellent property. Also the internal surface constituting the ink flow path 8 in the flow path forming member 4 is preferably made hydrophilic, in order to realize a smooth ink flow. In the conventional ink jet heads, a water-repellent treatment is applied on the discharge port-containing face 5 but a hydrophilic treatment is not applied to the internal surface of the ink flow path 8, formed in the interior of the flow path forming member 4. The layer (film) formed by Cat-CVD process can be made, by the selection of the material constituting the layer, into a water-repellent layer (film) and a hydrophilic layer (film) according to the characteristics required in the respective portions of the ink jet head.

Also the shape of the ink discharge port 6 significantly influences the ink discharge characteristics (for example a discharge direction of the ink droplet). However, a wet etching, if employed in forming the ink discharge port 6, may result in an unintended shape by an unnecessary etching such as an over-etch. Therefore, the discharge port is preferably formed by so-called dry etching technology, for example by forming a silicon-based protective layer by Cat-CVD process on the discharge port-containing face 5, and executing a reactive etching or a plasma etching utilizing the silicon-based protective layer as a mask.

However, in case of forming a silicon-based insulating layer by an ordinary plasma CVD on the surface of a structure of an organic resin, such as the material constituting the flow path forming member 4, such layer formation has to be executed at a substrate temperature of from 200 to 300° C., higher than a deformation temperature of the organic resin.

On the other hand, the Cat-CVD process can execute the film formation without heating the substrate holder and with the substrate even at the room temperature. Therefore, the film formation can be executed on the structure of organic resin, even at a substrate temperature lower than the deformation temperature of the organic resin. Thus, the Cat-CVD process can form a silicon-based protective layer on the structure formed by organic resin, without causing a deformation of such structure.

The Cat-CVD process enables to form a silicon-based protective layer (protective film) on the flow path forming member 4 or on the silicon substrate 2. Examples of the silicon-based protective layer include a silicon oxide (SiO) layer, a silicon nitride (SiN) layer, a silicon oxynitride (SiON) layer, a silicon oxycarbide (SiOC) layer, a silicon carbonitride (SiCN) layer, and a silicon carbide (SiC) layer.

The surface of the protective layer of SiC layer or SiOC layer has a contact angle to water of 80° or higher, thus being a water-repellent layer (film). By forming a protective layer of such materials by Cat-CVD process, a water-repellent protective layer can be formed directly on a predetermined surface (for example on the discharge port-containing face 5).

Also the surface of the protective layer of SiN layer or SiON layer has a contact angle to water of 40° or lower, thus being a hydrophilic layer (film). In the case that such hydrophilic protective layer is formed by Cat-CVD process and that a water-repellent property is to be provided on such hydrophilic protective layer, a water-repellent treatment can be applied by a method of laminating a water-repellent dry film or a method of forming a coated layer of a water-repellent resin.

Then, as to the part (2) above, a silicon-based protective layer formed by the Cat-CVD process in the interface (adhering surface) between the silicon substrate 2 and the flow path forming member 4 can improve the adhesivity of the flow path forming member 4 and the silicon substrate 2 at the interface thereof. In the adhering surface between the silicon substrate 2 and the flow path forming member, an adhesion layer 9 and a protective layer formed by Cat-CVD process may be present. Such construction enables to suppress the peeling between the flow path forming member 4 and the silicon substrate 2, induced by the ink. Also the protective layer in this part does not come into a direct contact with the ink, but is desirably hydrophilic, for the purpose of improving the adhesion between the flow path forming member 4 and the silicon substrate 2.

In the part (3) above, a silicon-based protective layer formed by the Cat-CVD process on the internal surface of the ink flow path 8 provided in the interior of the flow path forming member 4 enables to suppress a loss in reliability, induced by a deterioration or a deformation of the flow path forming member 4, caused by contact with the ink.

Also in the part (4) above, a silicon-based protective layer, formed the Cat-CVD process on the internal surface of the flow path forming member 4 constituting the discharge part 10, allows to suppress the deformation of the ink discharge port 6 induced by a deterioration or a deformation of the flow path forming member 4.

The part (5) described above has less possibility of contact with the ink in comparison with the parts (1) to (4), and will not be discussed in particular. This part is subjected to a water-repellent treatment, in most cases, practically simultaneously with the water-repellent treatment applied to the discharge port-containing face 5 of the part (1). In fact, in the exemplary embodiments to be described in the following, a protective layer is formed on an external lateral surface 4*a* of the flow path forming member 4 (part (5) described above) simultaneously with the protective layer formation by the Cat-CVD process on the discharge port-containing face 5.

An ink jet recording of a higher quality can be accomplished by producing an ink jet head which is provided with an ink jet substrate having the protective layer formed by the Cat-CVD process, and by mounting it on an ink jet recording apparatus (ink jet printer) constituting the liquid discharge apparatus.

In the following, there will be described a Cat-CVD apparatus and a protective layer forming method utilizing such apparatus.

Figure 3:
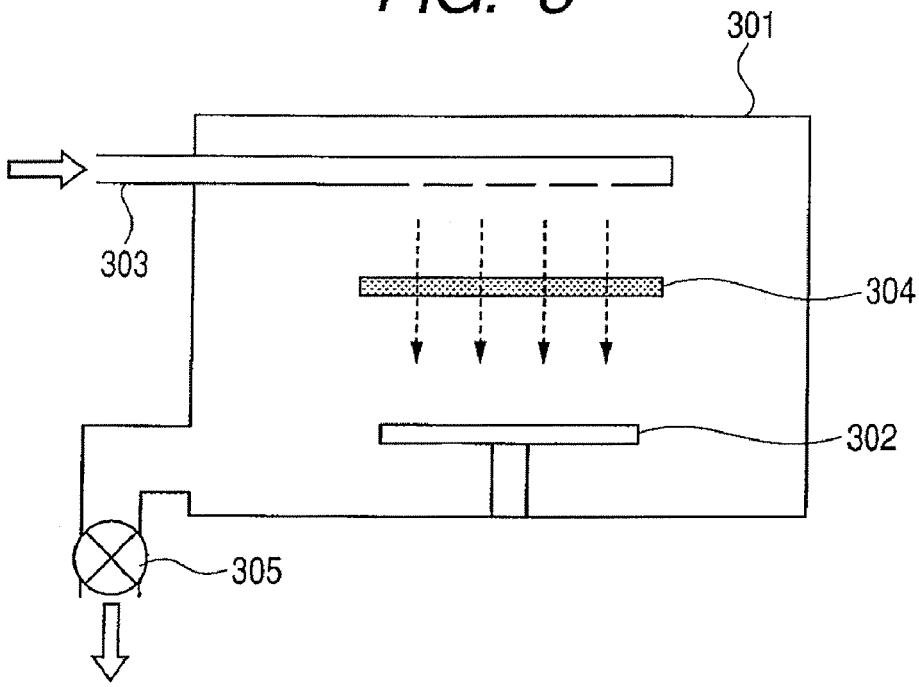
FIG. 3 is a schematic view of a Cat-CVD apparatus for forming a protective layer.

The Cat-CVD apparatus illustrated in FIG. 3 includes, in a film forming chamber 301, a substrate holder 302, a heater 304 serving as a catalyst member for catalytic decomposition of a gas, and a gas introducing part 303 for introducing a raw material gas so as to be in contact with the heater 304. Also a vacuum pump 305 is provided in order to reduce the pressure in the film forming chamber 301. Further provided is a temperature controller (not illustrated) for controlling the substrate temperature.

The Cat-CVD process is to heat a catalyst member (heater 304) formed for example of tungsten (W), to decompose a raw material gas in a catalytic reaction by the catalyst member, and to deposit molecules/atoms formed by the decomposition onto a silicon substrate or the like placed on the substrate holder 302 thereby forming a layer (film). Such principle enables to form a deposition layer on the surface of the object substance, without heating the substrate. Thus, the Cat-CVD process is capable of film formation even when the substrate temperature is about the room temperature or about 20° C.

Now the film formation by the Cat-CVD process, utilizing the apparatus illustrated in FIG. 3, will be will be described, taking a case of a SiOC layer as an example. At first the film forming chamber 301 is evacuated by the vacuum pump 305. Then a mixture of silane ($SiH_4$) gas, ammonia ($NH_3$) gas, dinitrogen monoxide ($N_2O$) gas, methane ($CH_4$) gas and hydrogen ($H_2$) at a predetermined proportion is introduced from the gas introducing part 303 into the film forming chamber 301. Then, after the substrate temperature is regulated, the heater 304 serving as the catalyst member is heated to 1700° C. A SiOC layer is formed by a catalytic decomposition reaction of the gasses by the catalyst member. Also a water-repellent layer varying in the atomic composition in the direction of thickness may be obtained by changing the introduced gas composition either continuously or stepwise. For example, a water-repellent layer varying in the atomic composition in the SiOC layer may be obtained by changing the flow rates of the gasses. Also a SiC layer can also be obtained by changing the types of gasses in the raw material gasses and the mixing ratio thereof.

On the other hand, in case of forming a SiN layer, monosilane ($SiH_4$), disilane ($Si_2H_6$) and the like may be employed as the raw material gas for silicon, and ammonia ($NH_3$) may be employed as the raw material gas for nitrogen. Also hydrogen ($H_2$) may be added for improving the coverage. Further, a SiON layer may be formed by adding a small amount of oxygen ($O_2$).

Also a SiC layer can be prepared from dimethylsilane (DMS), tetraethoxysilane (TEOS) or dimethyldimethoxysilane (DMDMOS). Furthermore, a SiOC layer can be prepared by adding oxygen ($O_2$) to the raw material gas.

In case of forming a SiN layer, a SiON layer, a SiOC layer, a SiCN layer or a SiC layer, such layer may also be formed for example by a plasma CVD process. However, the film formation by the plasma CVD process requires a substrate temperature of 200 to 300° C. or even higher at the film forming operation, so that the flow path forming member 4 of a resinous material will cause a deformation. In contrast, the Cat-CVD process can execute the film formation with a low substrate temperature of about 20° C. Therefore, even in case of forming a protective layer on the surface of the flow path forming member 4, a dense protective layer with little defects can be prepared without deformation of the flow path forming member 4.

Now there will be given descriptions on an ink jet head cartridge utilizing the ink jet head described above, and an ink jet recording apparatus in which the ink jet head cartridge is to be mounted.

The ink jet head of the present exemplary embodiment can be mounted in an apparatus such as a printer, a copying apparatus, a facsimile apparatus having a communication system, or a word processor having a printer unit, or further in an industrial recording apparatus combined with various processing apparatuses. Also this ink jet head enables recording on various recording media, such as paper, yarns, fibers, cloth, leather, metal, plastics, glass, timber and ceramics.

In the present specification, "recording" means not only providing the recording medium with a meaningful image such as a character or graphics but also providing a meaningless image such as a pattern.

Now there will be described an ink jet cartridge having a form of a cartridge in which the ink jet head is integrated with an ink tank, and an ink jet recording apparatus (ink jet printer) utilizing such cartridge.

Figure 4:
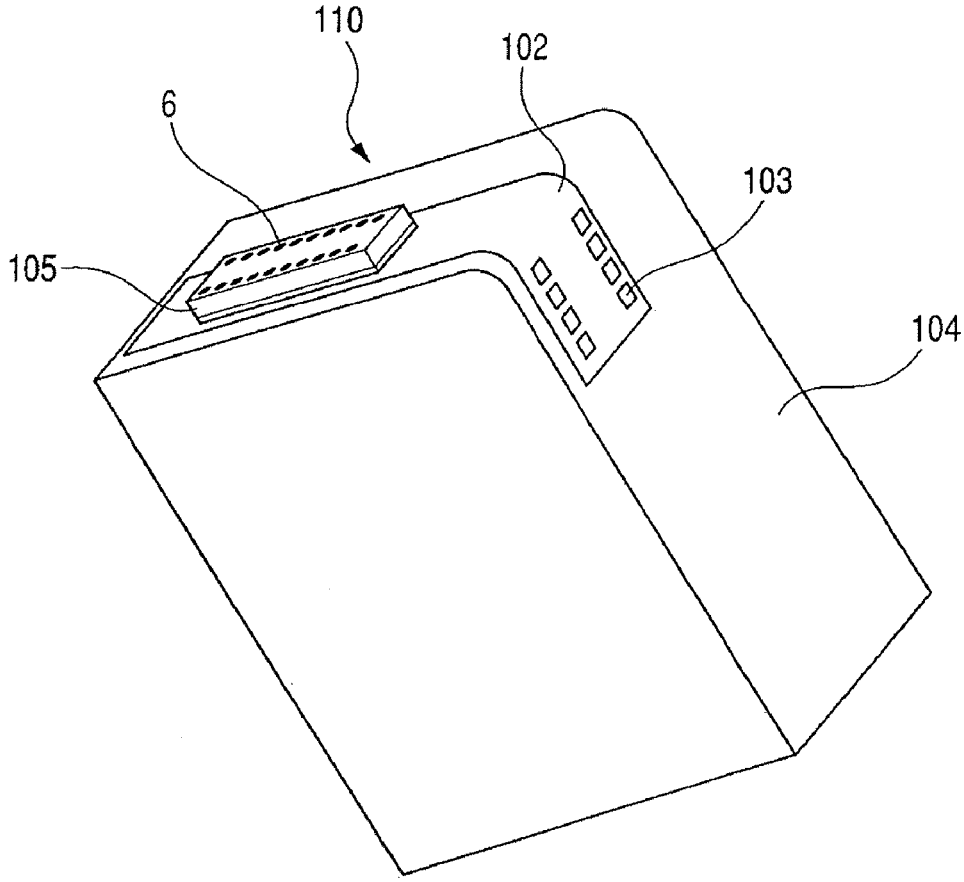
FIG. 4 is a perspective view illustrating an ink jet cartridge, prepared with an ink jet head embodying the present invention.

FIG. 4 illustrates an example of the constitution of an ink jet cartridge 110, constructed as a cartridge mountable on the ink jet recording apparatus.

The ink jet cartridge 110 includes an ink tank portion 104 and an ink jet head portion 105. Also on the surface of the casing of the in jet cartridge 110, provided is a tape member 102 for TAB (Tape Automated Bonding) having a terminal 103 for electric power supply to the ink jet cartridge 110 from the exterior. An electric connecting part of the ink jet head portion 105 is connected with wirings (not illustrated) extended from an external connection terminal 103 of the TAB tape member 102.

Figure 5:
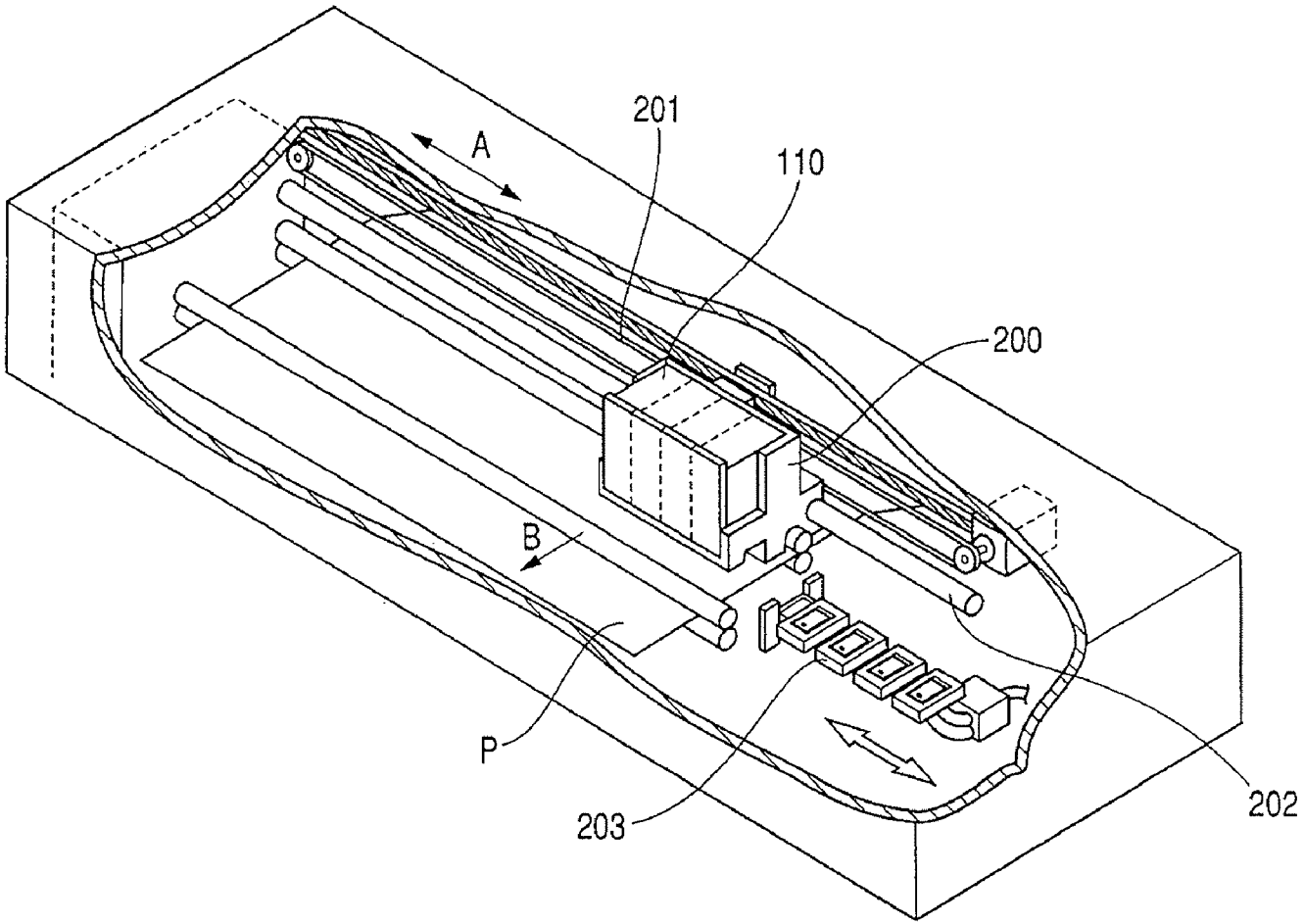
FIG. 5 is a schematic perspective view illustrating a constitutional example of an ink jet recording apparatus, utilizing the ink jet cartridge illustrated in FIG. 4.

FIG. 5 schematically illustrates a constitution of the ink jet recording apparatus executing recording with the ink jet cartridge 110 illustrate in FIG. 4.

The ink jet recording apparatus is equipped with a carriage 200 fixed to an endless belt 201, executing a main scanning in a reciprocating direction (direction A in the illustration) along a guide shaft 202.

On the carriage 200, mounted is an ink jet cartridge 110 of a cartridge structure. The ink jet cartridge 110 is mounted on the carriage 200 in such a manner that the ink discharge ports 6 are opposed to a paper P serving as the recording medium and that the direction of array of the ink discharge ports 6 is different from the scanning direction of the carriage 200 (for example it is in the conveying direction of the sheet P). Also the combination of the ink jet head portion 105 and the ink tank portion 104 may be provided in a number corresponding to the number of ink colors to be used, and, in the illustrated example, four sets are provided corresponding to four colors (for example black, yellow, magenta and cyan).

The recording paper P as the recording medium is intermittently conveyed in a direction B perpendicular to the moving direction of the carriage 200.

In the structure described above, the recording on the entire recording paper P is executed by alternately repeating a recording of a width corresponding to the length of the array of the ink discharge ports 6 in the ink jet cartridge 110 along the movement of the carriage 200 and the conveyance of the recording paper P.

The carriage 200 stops, at the start of recording or in the course of recording, whenever necessary, at a predetermined position in an end portion of the carriage moving range, called a home position. In the home position, there are provided a cap member 203 for capping a face of the ink jet cartridge 110 where the ink discharge ports 6 are provided (discharge port-containing face 5) and a rubber blade for wiping off the ink remaining on the discharge port-containing face 5 of the ink jet head. The cap member 203 is connected to a suction apparatus (not illustrated) for forcedly sucking the ink from the ink discharge ports 6 thereby preventing clogging of the ink discharge ports 6. Such structure including the rubber blade, the cap member, the suction apparatus and the like for cleaning the discharge port-containing face 5 and the ink discharge ports 6 is called recovery means which recovers and maintains the ink discharge performance.

In the following, a structure and a producing method for a silicon substrate 2, constituting the ink jet head substrate 1 embodying the present invention, will be described in detail with reference to the accompanying drawings.

First Embodiment

The discharge port-containing face 5 of the ink jet head is preferably subjected to a water-repellent treatment, and in fact has been subjected to a water-repellent treatment in practice. In the following exemplary embodiment, the formation of protective layer by the Cat-CVD process is most effective, and there will be described the formation of the protective layer by the Cat-CVD process on the discharge port-containing face 5, corresponding to (1) above.

The producing method described herein include following steps of: forming a mold member in an area on the base member where the flow path is to be formed later; forming a resin structure so as to cover the mold member; forming, on a face of the resin structure where a liquid discharge port is to be formed, a discharge port-containing face protective layer to be described later by the Cat-CVD process; forming an aperture in the discharge port-containing face protective layer and the resin structure, extending from a position for forming the liquid discharge port to the mold member; and removing the mold member thereby forming a liquid path in the interior of the resin structure.

As described in the foregoing, the shape of the ink discharge port 6 significantly influences the ink discharge characteristics (for example a discharge direction of the ink droplet). However, the present exemplary embodiment enables to form the ink discharge port 6 by the dry etching method on the discharge port-containing face 5. Also it avoids the direct contact of the flow path forming member 4 and the ink (droplet) thereby suppressing the swelling of the flow path forming member 4 by the ink. Furthermore, the protective layer can be formed at a temperature lower than the deformation temperature of the material constituting the flow path forming member 4. It is thus made possible to producing the ink discharge port 6 in an exact shape, and to suppress deformation in the flow path forming member 4 and in the ink discharge port 6, thereby providing an ink jet head capable of a recording of a higher quality.

Now the producing process for the ink jet head substrate 1 illustrated in FIG. 1 will be described, utilizing the schematic cross-sectional views in FIGS. 6A, 6B, 6C, 6D, 6E, 6F, 6G, 6H and 6I.

On a top surface and a bottom surface of a silicon (Si) substrate 2 having a surface orientation <100>, a $SiO_2$ layer of a thickness of 0.7 μm is formed by thermal oxidation. The $SiO_2$ layer formed on a surface (top surface) of the silicon substrate 2 serves to isolate the respective semiconductor elements of drive circuits (not illustrated) for driving the heat generating parts 3 constituting the discharge energy generating elements for ink discharge. Also the $SiO_2$ 12 layer formed on the other surface (rear surface) of the silicon substrate 2 is used as an etching mask for forming the ink supply opening 7 in a later stage.

Figure 6A:
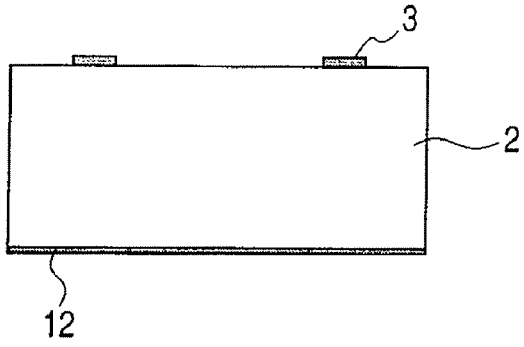

Thereafter, on the top surface of the silicon substrate 2, ordinary semiconductor manufacturing technology is applied to prepare heat generating parts 3 and drive circuits (not illustrated) formed by semiconductor elements for driving the heat generating parts 3. As signals for driving the drive circuits are supplied from the exterior to the drive circuits, there are provided input electrodes (not illustrated) for receiving the external signals for driving the drive circuits. Thereafter, on the top surface of the silicon substrate 2, the heat generating parts 3 are formed for example by a method described in Japanese Patent Application Laid-Open No. H08-112902 (FIG. 6A).

Also if necessary, a protective layer (not illustrated) for protecting the heat generating part 3 and the wirings from the ink is provided in a predetermined position of the silicon substrate 2. The ink jet head can be obtained by forming a flow path forming member 4 and the like on such protective layer.

Figure 6B:
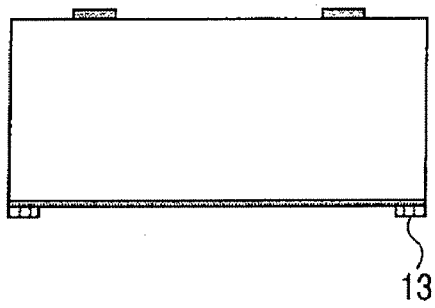

On the $SiO_2$ layer 12 on the rear surface of the silicon substrate 2, a patterning mask 13 is formed as a mask for forming the ink supply opening 7. It is formed by a method of coating and curing a masking agent for example by spin coating on the entire rear surface of the silicon substrate 2, then coating and drying a positive resist thereon for example by spin coating, then patterning the positive resist by a photolithographic technology, and removing an exposed portion of the masking agent, for constituting the patterning mask 13, by a dry etching. Finally the positive resist is stripped off to obtain the patterning mask 13 of the desired pattern (FIG. 6B).

Figure 6C:
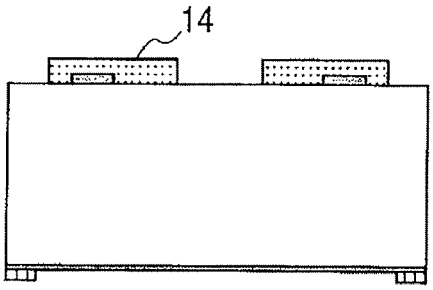

Then a positive photoresist is coated, for example by spin coating, on the top surface of the silicon substrate 2 so as to obtain a layer of a predetermined thickness. Then in a photolithographic process, executed are an exposure with an ultraviolet or deep-UV light and a development to obtain a mold member 14 of a desired thickness and a desired pattern in a portion over the heat generating part 3 on the silicon substrate 2. The mold member 14 is dissolved out in a later stage, and a space formed by such dissolution constitutes an ink flow path. The mold member 14 is formed, in order to obtain an ink flow path of a desired height and a desired planar pattern, with a corresponding layer thickness and a corresponding planar pattern (FIG. 6C).

Subsequently, on the top surface of the silicon substrate 2, a material for forming the flow path forming member 4 is coated for example by spin coating. Thereafter, an area to be removed in a later stage is exposed, utilizing a mask.

The material of the flow path forming member 4 can be selected from publicly known photosensitive resins (compositions) such as a positive-type photosensitive epoxy resin, and a photosensitive acrylic resin. The flow path forming member 4 is to form an ink flow path therein, and is therefore in constant contact with the ink while the ink jet head is in use. Therefore, a photocurable epoxy resin is suitable as the material. Also other materials may be selected according to the ink to be employed, as the durability and the like of the flow path forming member 4 are significantly affected by the type and characteristics of the ink to be employed.

Figure 6D:
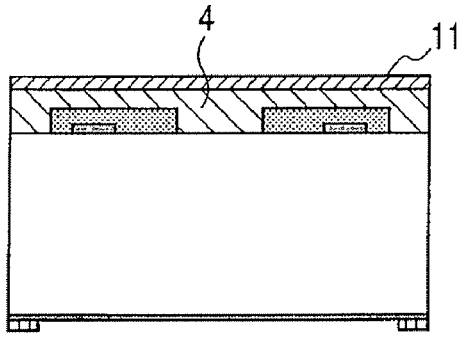

Then, on the top surface of the flow path forming member 4, a silicon-based protective layer 11 is formed by the Cat-CVD process (FIG. 6D). In this operation, an external lateral face 4*a* of the flow path forming member 4 is simultaneously covered by the protective layer 11 (not illustrated). This protective layer 11 becomes a discharge port-containing face protective layer to be described later.

Figure 6E:
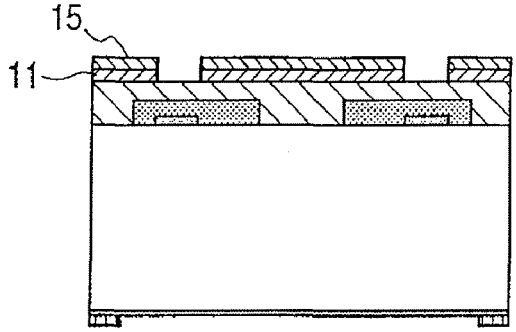

Thereafter a positive photoresist layer 15 is formed, and this positive photoresist layer 15 is patterned by a photolithographic process. Subsequently, utilizing thus patterned photoresist layer 15 as a mask, an exposed portion of the protective layer 11 is removed for example by dry etching (FIG. 6E).

Figure 6F:
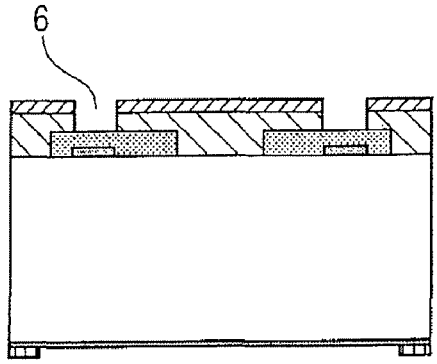

Thereafter the flow path forming member 4 is etched off by dry etching to form an ink discharge port 6 (FIG. 6F). Thus an aperture is formed in the discharge port-containing face protective layer and the flow path forming member 4, extending from the discharge port 6 to the mold member 14.

Now the ink discharge port 6 is opened by a dry etching technology. The dry etching has following advantages in comparison with a wet etching executed by exposing and developing a photosensitive resin:

(1) an ink discharge port 6 of an aperture of a small area and a fine shape can be formed precisely; and (2) the material for the flow path forming member 4 has a wider freedom of selection as it is not required to be photosensitive.

For dry etching of the flow path forming member 4, the patterned photoresist layer 15 may be utilized as a mask, or the patterned protective layer 11 may be utilized as a hard mask.

Subsequently, utilizing the patterning mask 13 as a mask, the $SiO_2$ layer 12 is patterned for example by wet etching thereby removing a part of the $SiO_2$ layer 12. In the removed portion, the rear surface of the silicon substrate 2 is exposed, thus constituting an aperture for starting an etching for forming the ink supply opening 7.

Figure 6G:
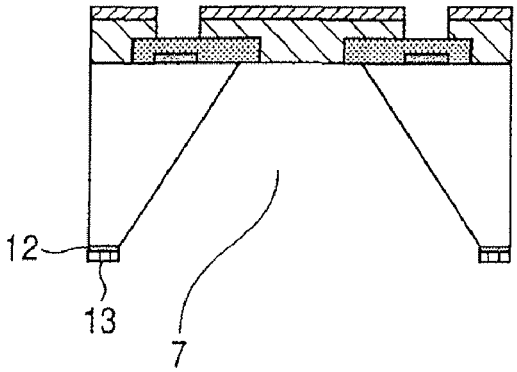

Then an ink supply opening 7, constituting a penetrating hole through the silicon substrate 2, is formed by an anisotropic etching utilizing the $SiO_2$ layer 12 as a mask (FIG. 6G).

In this operation, the top surface of the silicon substrate 2, bearing the functional elements (heat generating parts 3 and drive circuits) and the flow path forming members 4, and the lateral side of the substrate are covered in advance by a protective material (not illustrated) so as not to be contacted by the etching solution.

Finally, the patterning mask 13 and the protective material (not illustrated) are removed. Thereafter, the mold member 14 is dissolved out and removed from the ink discharge port 6 and the ink supply opening 7 (FIG. 6H).

After the removal of the mold member 14, the ink jet head substrate 1 is dried, thereby completing the process for preparing the ink discharge port 6 and the ink supply opening 7. Thereafter, an electrical connection part, for external electric power supply and for signal exchange for driving the heat generating part 3, is provided to complete the ink jet head.

Figure 6H:
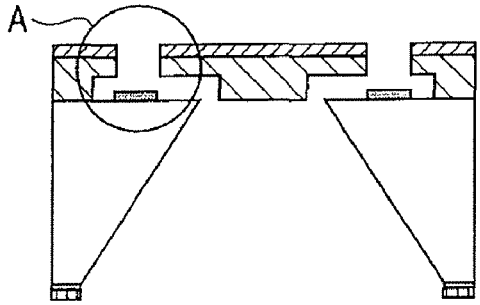
Figure 6I:
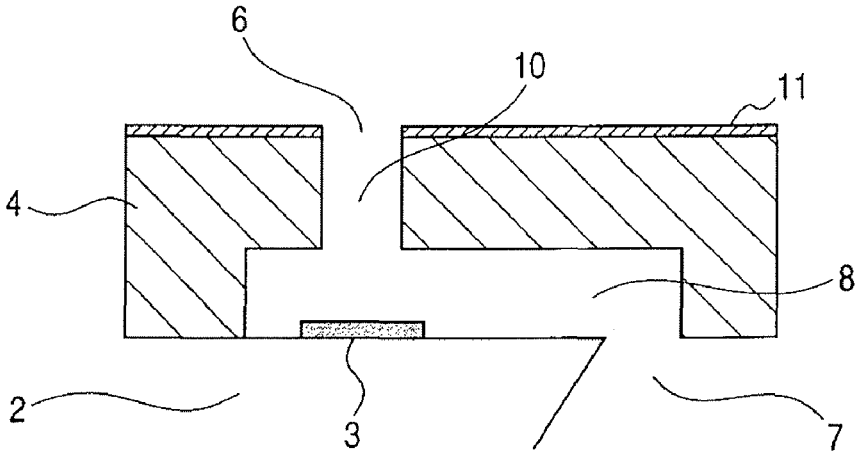

FIG. 6I is a magnified schematic view of a part indicated by a circle in FIG. 6H.

Figure 7A:
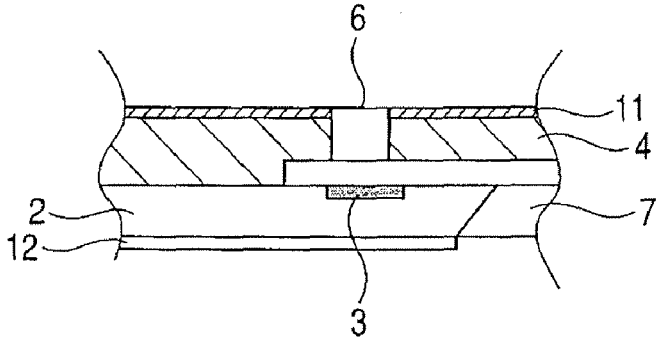

FIG. 7A is a magnified schematic cross-sectional view of the vicinity of the ink discharge port 6, having the protective layer 11 formed by the Cat-CVD process. The protective layer 11 formed by the Cat-CVD process is preferably formed by a SiO layer, a SiN layer, a SiON layer, a SiOC layer, a SiCN layer or a SiC layer. Among these, the protective layer formed by a SiC layer, a SiOC layer or a SiCN layer has a water-repellent property, so that, by forming a protective layer of such material by the Cat-CVD process, a protective layer having a water-repellent property can be formed directly on a predetermined surface requiring a water-repellent property (the discharge port-containing face 5 in the present exemplary embodiment).

The protective layer 11 to be formed on the flow path forming member 4 preferably has a thickness of 0.5 μm or larger, as it is formed on the discharge port-containing face 5 which is contacted by the rubber blade for scraping off the ink. An upper limit of the thickness is not particularly restricted, but is generally considered as about 3 to 5 μm, since a larger thickness required a longer time for film formation and for dry etching, thereby deteriorating the productivity.

In case of utilizing the protective layer 11 as a hard mask for forming the ink discharge port 6 in the flow path forming member 4, the protective layer 11 is preferably formed by a SiN layer, a SiON layer, a SiCN layer or a SiC layer which has a high etching selectivity to the organic resin in the anisotropic dry etching.

Also in case of utilizing a positive photosensitive epoxy resin as the material of the flow path forming member 4, the film formation by the Cat-CVD process has to be executed with a substrate temperature lower than 200° C. since the photosensitive epoxy resin softens and starts to deform at about 200° C. Also in case of utilizing a photosensitive acrylic resin as the material of the flow path forming member 4, the film formation by the Cat-CVD process has to be executed with a substrate temperature lower than 150° C., since the photosensitive acrylic resin has a deformation temperature of about 150° C. Based on these, the substrate temperature at the film formation by the Cat-CVD process is preferably equal to or lower than the deformation temperature of the material constituting the flow path forming member 4.

In the case that the protective layer 11 is hydrophilic, the ink remains on the discharge port-containing face 5 thus leading to a clogging of the ink discharge port 6. It is therefore necessary to modify the discharge port-containing face 5 to water-repellent. In order to provide the protective layer 11 of a SiO layer, a SiN layer or a SiON layer with a water-repellent property (contact angle to water of 80° or larger), there may be utilized following water-repellent treatment:

(1) Fluorine ions are implanted by ion implantation to the surface of the protective layer 11, thereby modifying the surface of the protective layer 11. In this manner, a repellent property to ink can be provided to the surface of the protective layer 11.

Figure 7B:
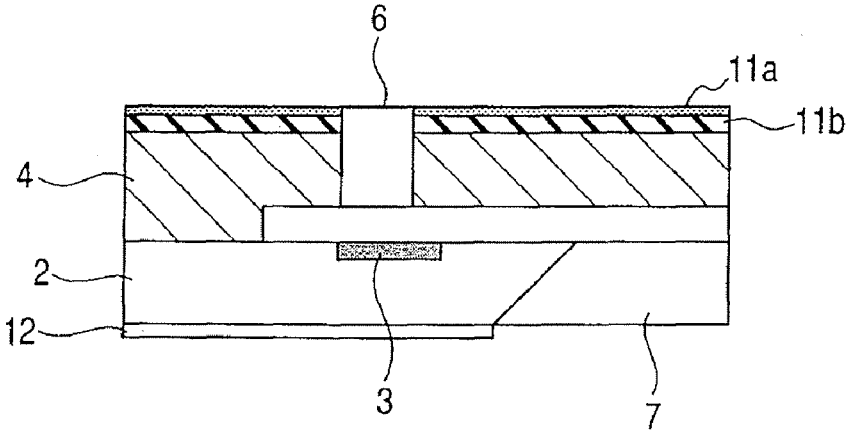

By the ion implantation, as illustrated in FIG. 7B, an upper layer of the protective layer 11 is modified to a water-repellent protective layer 11*a*, while a lower layer remains as an unmodified hydrophilic protective layer 11*b*. Also depending on the thickness of the protective layer 11 and the condition of the ion implantation, the entire protective layer 11 may be modified as the water-repellent protective layer 11*a*.

Figure 7C:
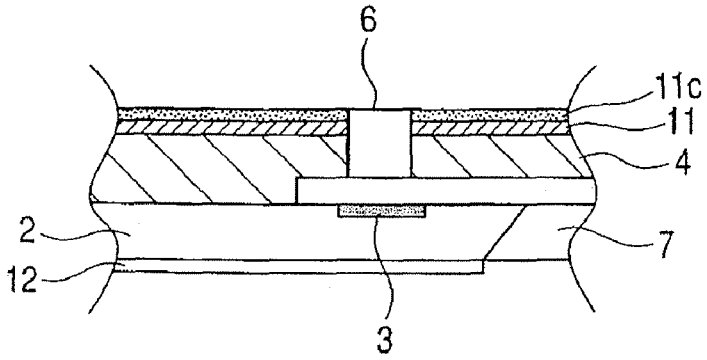

(2) As illustrated in FIG. 7C, on the protective layer 11 (on the surface of the protective layer 11), another water-repellent layer 11*c* is newly formed as the protective layer. In this case, after the formation of the protective layer 11 illustrated in FIG. 6D, the water-repellent layer 11*c* is formed by coating, and the water-repellent layer 11*c* and the protective layer 11 are removed in a single step by dry etching, utilizing a photoresist as a mask. For such water-repellent layer 11*c*, an already known fluorine- or silicon-containing organic resin may be utilized.

In the conventional method in which the SiO layer, SiN layer, SiON layer, SiOC layer, SiCN layer or SiC layer is formed by plasma CVD process on the protective layer 11, a substrate temperature of from 200 to 300° C. or even higher is necessary for obtaining a layer (film) of satisfactory quality. Therefore, the film formation by the plasma CVD process on the flow path forming member 4 of a resinous material results in a deformation of the flow path forming member 4. However, the Cat-CVD process described in the present exemplary embodiment is capable of film formation with a low substrate temperature of the room temperature or of about 20° C. at the film forming operation. Therefore, even in a step after the formation of the flow path forming member 4 on the silicon substrate 2, a dense protective layer with little defects can be formed without causing a deformation in the flow path forming member 4.

In this manner the principal preparation process for the ink jet head substrate 1 is completed. On thus formed ink jet head substrate 1, electrical connecting parts for driving the heat generating part 3 and an ink tank for ink supply are mounted according to the necessity. It is naturally possible to utilize, in preparing the ink jet head substrate 1, so-called multiple chip division, commonly utilized in the semiconductor manufacture. In such multiple chip division, devices (ink jet heads in the present case) are prepared in a grating pattern on a same substrate. The devices formed in an array of plural units on the substrate are then divided, for example by dicing, into the individual chips.

Second Exemplary Embodiment

In the following exemplary embodiment, there will be described a producing method for forming protective layers in the aforementioned portions (1) to (4) by the Cat-CVD process, utilizing the schematic cross-sectional views in FIGS. 8A, 8B, 8C, 8D, 8E, 8F, 8G, 8H, 8I, 8J and 8K illustrating the respective process steps.

The producing method described here includes following process steps of: forming a mold member in an area of the base member in which a flow path is to be formed; forming, on the base member by the Cat-CVD process, a flow path internal surface protective layer (details being described later) which covers the mold member and constitutes a layer for protecting the internal surface of the flow path, and an interface protective layer (details being described later) which protects an interface of the base member and the resin structure; forming, on the flow path internal surface protective layer and the interface protective layer, a resin structure covering the energy generating element; forming an aperture, on a surface of the resin structure where the liquid discharge port is to be formed, extending from a position for forming the liquid discharge port to the mold member; and removing the mold member thereby forming the liquid path in the interior of the resin structure.

Furthermore, between the step of forming the aforementioned aperture and the step of forming the liquid path in the interior of the resin structure, there is included a step of forming, by the Cat-CVD process, a discharge port-containing face protective layer (details being described later) for protecting a surface of the resin structure where the discharge port is to be formed.

As described above, the portions (2) to (4) are advantageously hydrophilic, while the portion (1) is required to be water-repellent. The producing method of the present exemplary embodiment is to form hydrophilic protective layers by the Cat-CVD process in the portions (1) to (4) and then to apply the water-repellent treatment described in the first exemplary embodiment in the portion (1) (discharge port-containing face 5). This method enables to cover the internal surface (internal wall) constituting the ink flow path 8 in the flow path forming member 4, including also the discharge part 10, with a hydrophilic protective layer. Furthermore, it can also cover the interface (all or partially) between the flow path forming member 4 and the silicon substrate 2, by a protective layer.

Figure 8A:
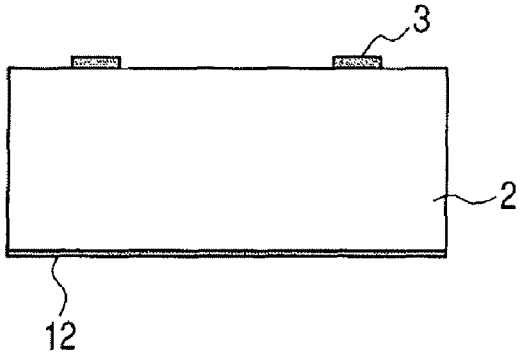

The producing method of the present exemplary embodiment will be described below. At first, a $SiO_2$ layer 12 is formed on the top surface and the rear surface of a silicon substrate 2, and a heat generating part 3 is formed on the top surface (FIG. 8A). Details of this step are same as described in FIG. 6A in the first exemplary embodiment.

Figure 8B:
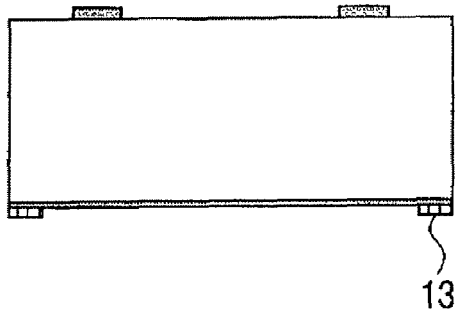

Then, a patterning mask 13 is formed on the $SiO_2$ layer 12 on the rear surface of the silicon substrate 2 (FIG. 8B). Details of this step are same as described in FIG. 6B in the first exemplary embodiment.

Figure 8C:
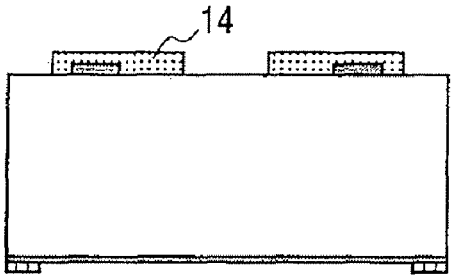

Subsequently, a mold member 14 is formed on the top surface of the silicon substrate 2, so as to cover the heat generating part 3 (FIG. 8C). Details of this step are same as described in FIG. 6C in the first exemplary embodiment.

Figure 8D:
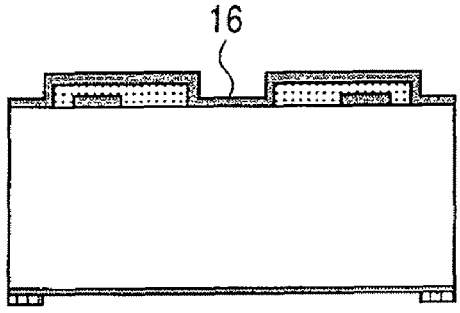

Then, a first protective layer is formed by the Cat-CVD process, on the top surface of the silicon substrate 2, so as to cover the mold member 14 and the top surface of the silicon substrate 2 where the mold member 14 is not provided. Such protective layer, formed by the initial Cat-CVD process, is called a primarily formed protective layer 16 (FIG. 8D). The primarily formed protective layer 16 covering the mold member 14 becomes a part of a flow path internal surface protective layer 19 in the ink flow path 8 after the head is completed. Also the primarily formed protective layer 16, covering the top surface of the silicon substrate 2 where the mold member 14 is not formed, becomes, in a part, an interface protective layer 20 between the flow path forming member 4 and the silicon substrate 2 after the head is completed. Such primarily formed protective layer 16 is advantageously formed by a hydrophilic layer such as a SiN layer or a SiON layer. Also in this operation, the Cat-CVD apparatus has such a substrate temperature that does not cause a thermal deformation of the mold member 14 formed by a positive photoresist material. In the present exemplary embodiment, the temperature is preferably 150° C. or lower, more preferably 200° C. or lower.

Figure 8E:
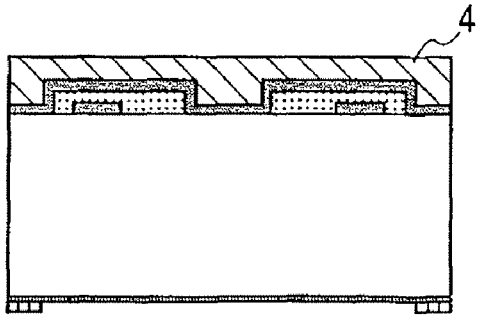

Subsequently, a photosensitive resinous material is coated, for example by spin coating, so as to cover the mold member 14 and the primarily formed protective layer 16, thereby forming a flow path forming member 4 (FIG. 8E). The selection of material for the flow path forming member 4 and the specific forming method thereof are similar to those described in FIG. 6D in the first exemplary embodiment.

Figure 8F:
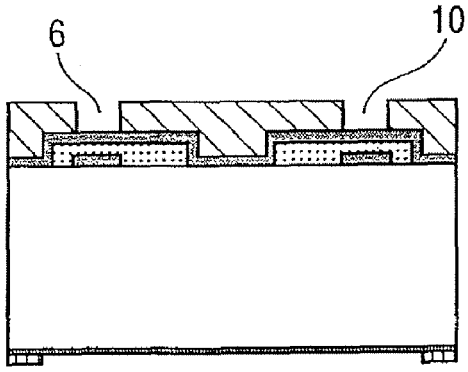

Then the photosensitive resinous material, constituting the flow path forming member 4, is patterned by a photolithographic process to remove portions for forming the ink discharge port 6 and the discharge part 10, and is then cured (FIG. 8F).

Figure 8G:
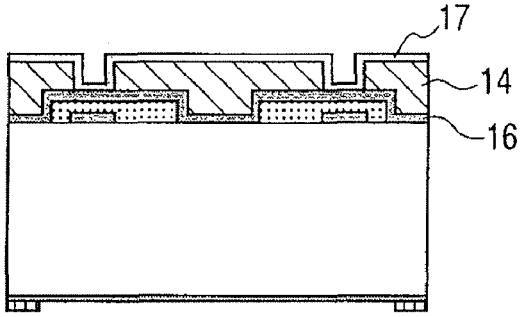

Then a protective layer, covering the surface (discharge port-containing face 5) of the flow path forming member 4 and an internal surface extending from the ink discharge port 6 (internal surface of the flow path in the discharge part 10), is formed by the Cat-CVD process. The protective layer formed by this second Cat-CVD process is called a secondarily formed protective layer 17 (FIG. 8G). The internal surface of the flow path in the discharge part 10, constituting a part of the ink flow path 8, is advantageously formed as hydrophilic. Therefore, the secondarily formed protective layer 17 can be made with a hydrophilic layer such as a SiN layer or a SiON layer. Also in this operation, the Cat-CVD apparatus has such a substrate temperature, as in the first exemplary embodiment, that does not cause a thermal deformation of the mold member 14 formed by a positive photoresist material.

Figure 8H:
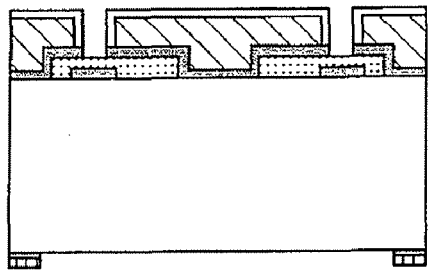

Then, on the secondarily formed protective layer 17, which is formed on the discharge port-containing face 5, a positive photoresist (not illustrated) is coated for example by spin coating, and then dried. Then the positive resist is patterned by a photolithographic process to form a mask, and the secondarily formed protective layer 17 exposed in the bottom of the aperture for forming ink discharge port 6 and the primarily formed protective layer 16 thereunder are removed by dry etching. In this manner completed is the discharge part 10 having a hydrophilic protective layer on the internal surface of the flow path. Finally the positive resist is stripped off (FIG. 8H). In this manner an aperture, extending from the ink discharge port 6 to the mold member 14, is formed in the discharge port-containing face protective layer, to be described later, and in the flow path forming member 4.

The secondarily formed protective layer 17 may be so formed as to cover the entire area of the discharge port-containing face 5, but may be so patterned as to partially cover the discharge port-containing face 5 within an extent of attaining the desired effect. This applies also to a third exemplary embodiment to be described later.

The secondarily formed protective layer 17 formed on the discharge port-containing face 5, being hydrophilic to the ink as described above, is desirably modified to water-repellent property at least in a surface thereof, for example by the method described in the first exemplary embodiment. More specifically, a water-repellent layer is formed by laminating a water-repellent dry film on the surface of the secondarily formed protective layer 17 present on the discharge port-containing face 5, or coating the surface with a water-repellent resin. It is also possible, after the formation of the secondarily formed protective layer 17, to implant fluorine ions in a range from the surface of the secondarily formed protective layer 17 to a predetermined depth thereof by ion implantation process, thereby executing a surface modification of the secondarily formed protective layer 17. In such case, the fluorine ion implantation is executed in such a manner that the fluorine ions are not implanted in the secondarily formed protective layer 17 covering the internal surface of the ink flow path 8 of the discharge part 10 and not requiring the water-repellent treatment. More specifically, the ion implantation can be advantageously made perpendicularly to the surface of the substrate or to the opening surface of the ink discharge port 6.

Such treatment provides the surface of the secondarily formed protective layer 17 on the discharge port-containing face 5, with a repellent effect to the ink. On the other hand, the secondarily formed protective layer 17 covering the internal surface of the ink flow path of the discharge part 10 retains the hydrophilic property.

In the ink jet head substrate 1 obtained by the above-described construction, the parts (3) and (4) above are protected by the hydrophilic primarily formed protective layer 16, while the part (2) above is protected by the hydrophilic secondarily formed protective layer 17. Also the part (1) above is protected by the hydrophilic secondarily formed protective layer 17, of which surface is modified to the water-repellent property. Also the part (5) above (external lateral surface 4*a* of the flow path forming member 4) is substantially protected, at the formation of the secondarily formed protective layer 17 in the process illustrated in FIG. 8G, simultaneously by the secondarily formed protective layer 17.

Figure 8I:
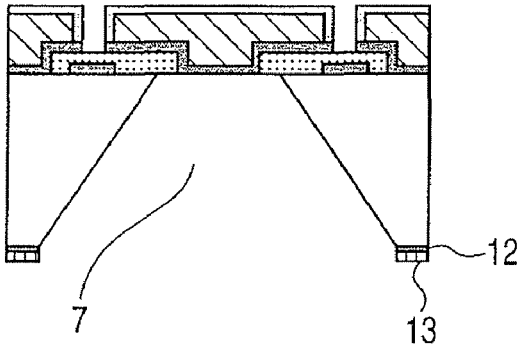

Then an ink supply opening 7, constituting a penetrating hole through the silicon substrate 2, is formed by an anisotropic etching utilizing the $SiO_2$ layer 12 as a mask (FIG. 8I). In this operation, the top surface of the silicon substrate 2, bearing the functional elements (heat generating parts 3 and drive circuits) and the flow path forming members 4, and the lateral side of the substrate are covered in advance by a protective material (not illustrated) so as not to be contacted by the etching solution. This is same as illustrated in FIG. 6G in the first exemplary embodiment.

Figure 8J:
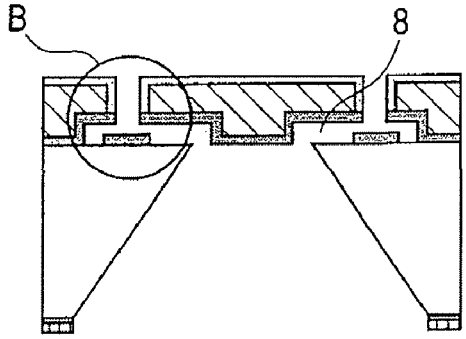

Finally, the patterning mask 13 and the protective material (not illustrated) are removed. Thereafter, the mold member 14 is dissolved out and removed from the ink discharge port 6 and the ink supply opening 7 (FIG. 8J). This is same as illustrated in FIG. 6H in the first exemplary embodiment.

After the removal of the mold member 14, the ink jet head substrate 1 is dried, thereby completing the process for preparing the ink discharge port 6 and the ink supply opening 7. Thereafter, an electrical connection part, for external electric power supply and for signal exchange for driving the heat generating part 3, is provided to complete the ink jet head.

Figure 8K:
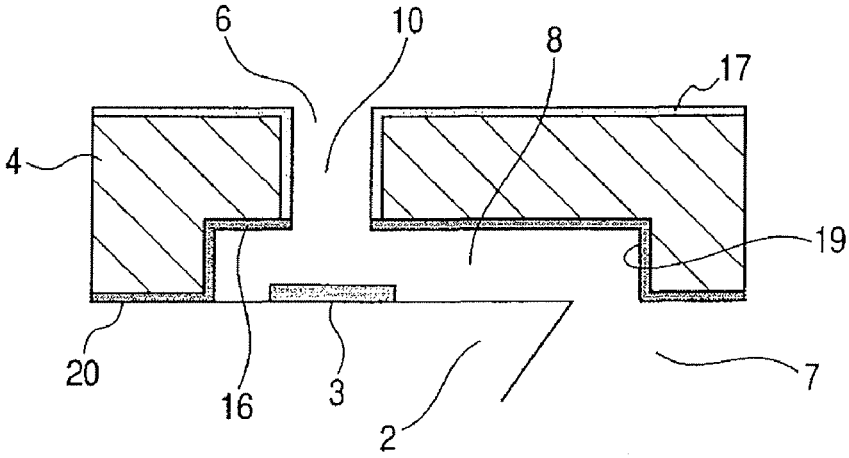

FIG. 8K is a magnified schematic view of a part indicated by a circle in FIG. 8J.

The secondarily formed protective layer 17 to be formed on the flow path forming member 4 preferably has a thickness of 0.5 μm or larger, as it is formed on the discharge port-containing face 5 which is contacted by the rubber blade for scraping off the ink. An upper limit of the thickness is not particularly restricted, but is generally considered as about 3 to 5 μm, since a larger thickness required a longer time for film formation and for dry etching, thereby deteriorating the productivity.

In case of utilizing a positive photosensitive epoxy resin as the material of the flow path forming member 4, the film formation by the Cat-CVD process has to be executed with a substrate temperature lower than 200° C. since the photosensitive epoxy resin softens and starts to deform at about 200° C. Also in case of utilizing a photosensitive acrylic resin as the material of the flow path forming member 4, the film formation by the Cat-CVD process has to be executed with a substrate temperature lower than 150° C., since the photosensitive acrylic resin has a deformation temperature of about 150° C. Based on these, the substrate temperature at the film formation by the Cat-CVD process is preferably equal to or lower than the deformation temperature of the material constituting the flow path forming member 4. Similarly, the primarily formed protective layer 16 is advantageously formed at a substrate temperature equal to or lower than a temperature at which the resinous mold member 14 starts thermal deformation.

The ink jet head substrate 1 prepared through the above-described steps have following structure.

The heat generating part 3, the drive element and wirings therefor, disposed on the surface of the silicon substrate 2 at the lowermost surface of the ink flow path, are covered by an $SiO_2$ layer for protection from the ink.

Also the discharge port-containing face 5 bears a protective layer (discharge port-containing face protective layer) formed by the Cat-CVD process. Also an interface between the silicon substrate 2 and the flow path forming member 4 is covered by an interface protective layer 20, formed by the Cat-CVD process. The interface protective layer 20 constitutes a part of the primarily formed protective layer 16. In the adhering surface (adhering portion) between the silicon substrate 2 and the flow path forming member, an adhesion layer 9 and a protective layer formed by the Cat-CVD process may be present. Further, the internal surface (internal wall) of the ink flow path 8, in the interior of the flow path forming member 4, and the internal surface of the flow path in the discharge part 10, constituting a part of the ink flow path 8, are covered by the flow path internal surface protective layer 19 formed by the Cat-CVD process. The flow path internal surface protective layer 19 is formed by the primarily formed protective layer 16 and the secondarily formed protective layer 17.

A water-repellent treatment is applied to the protective layer of the discharge port-containing face 5 (discharge port-containing face protective layer) to suppress an ink deposition on such face, thereby enabling a recording of a high recording quality. Also the protective layer (flow path internal surface protective layer 19) formed by the Cat-CVD process on the internal surface of the ink flow path 8, having a hydrophilic surface, realizes formation of a smooth ink flow thereby enabling a stable bubble formation in the ink and a stable ink discharge. Also the interface protective layer 20 formed by the Cat-CVD process at the interface between the silicon substrate 2 and the flow path forming member 4 suppresses the contact with the ink and the penetration thereof, thereby contributing to an increased adhesivity of the two.

Third Exemplary Embodiment

Figure 9A:
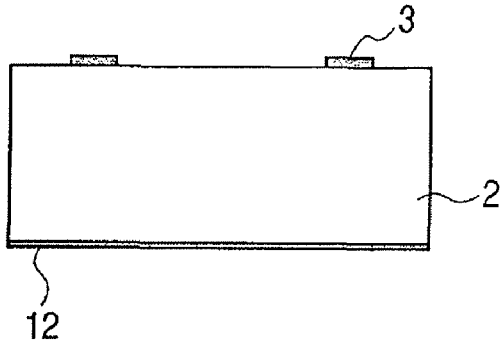
Figure 9B:
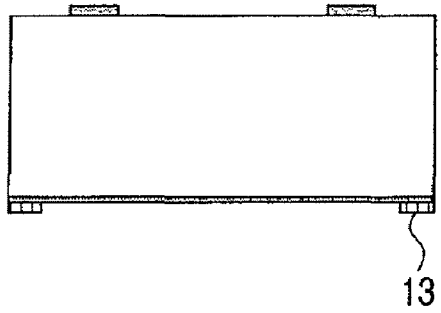
Figure 9C:
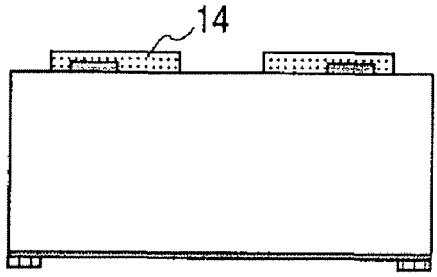
Figure 9D:
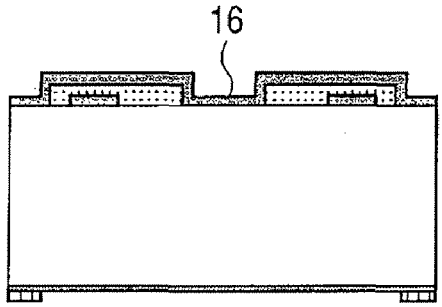
Figure 9E:
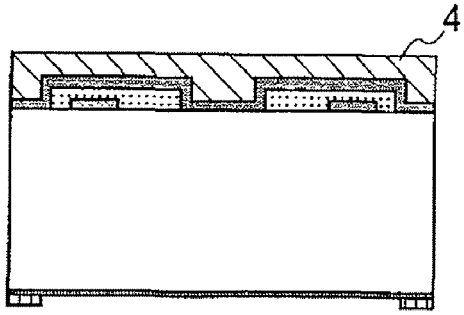
Figure 9F:
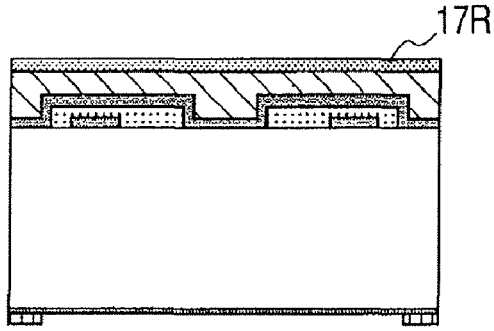
Figure 9G:
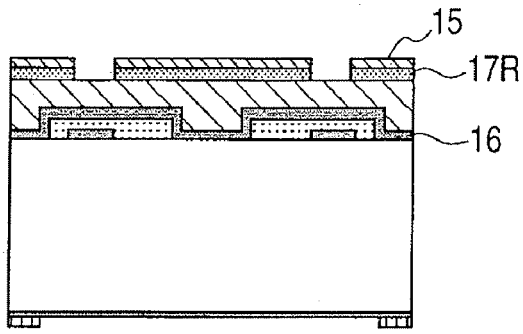
Figure 9H:
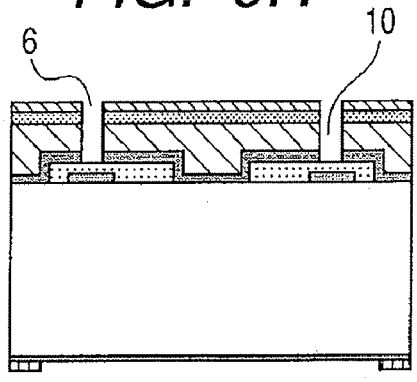
Figure 9I:
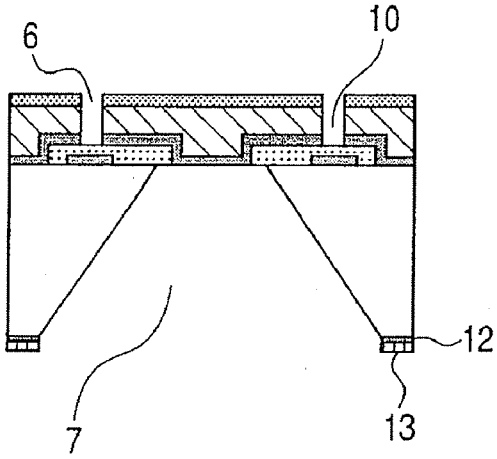
Figure 9J:
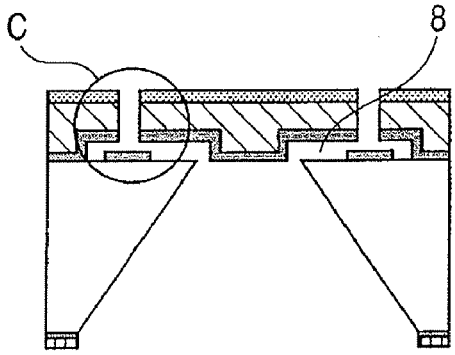
Figure 9K:
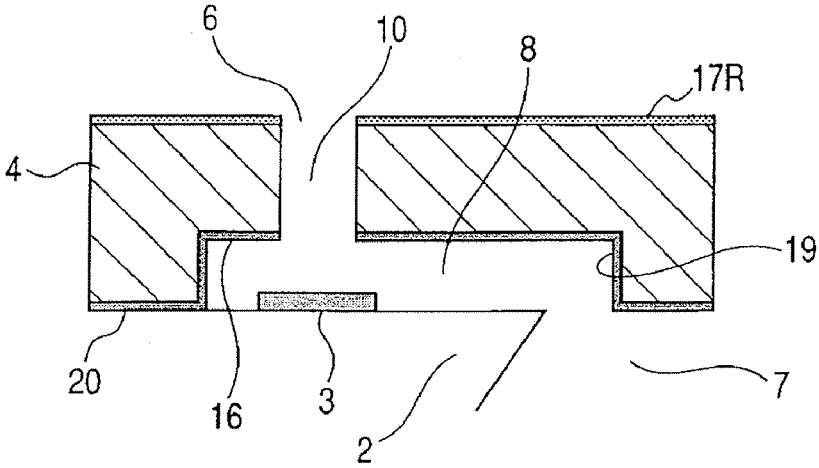

In the following exemplary embodiment, there will be described a producing method for forming protective layers in the aforementioned portions (1) to (4) by the Cat-CVD process, utilizing the schematic cross-sectional views in FIGS. 9A, 9B, 9C, 9D, 9E, 9F, 9G, 9H, 9I, 9J and 9K illustrating the respective process steps. The present exemplary embodiment is different from the second exemplary embodiment in that a hydrophilic protective layer is formed by the Cat-CVD process in at least the parts (3) and (4), but a water-repellent protective layer is formed by the Cat-CVD process in the part (1). FIGS. 9A to 9E illustrate same process steps as in FIGS. 8A to 8E. In particular, the primarily formed protective layer 16 is same as that in the second exemplary embodiment. Also FIGS. 9I and 9J illustrate same process steps as in FIGS. 8I and 8J. Therefore the substrate temperature for forming each protective layer is selected at a temperature not causing a thermal deformation of the material for forming the protective layer, and the film forming conditions are same as those in the foregoing exemplary embodiments.

At first, a protective layer covering the surface (discharge port-containing face 5) of the flow path forming member 4, formed by a photosensitive resinous material, is formed by the Cat-CVD process (FIG. 9F). This protective layer is a SiC layer, a SiOC layer or a SiCN layer, having water-repellent property. This is a protective layer formed by the second Cat-CVD process in the present exemplary embodiment, but it is water-repellent in contrast to the aforementioned secondarily formed protective layer 17 and is therefore called a secondarily formed protective layer 17R.

Then a positive resist 15 is coated for example by spin coating and dried on the secondarily formed protective layer 17R. Then the positive resist 15 is patterned by a photolithographic process as a mask, which is used for patterning the secondarily formed protective layer 17R. In this manner, a mask of a two-layered structure is obtained on the surface of the discharge port-containing face 5 (FIG. 9G).

Then a dry etching is executed utilizing this two-layered mask. This process removes the photosensitive resin and the primarily formed protective layer 16, which are not protected by the mask (FIG. 9H). The removal of the photosensitive resin forms the discharge part 10 constituting a part of the ink flow path 8. Also the removed primarily formed protective layer 16 is in a portion covering the mold member 14, opposed to the ink discharge port 6.

Then the positive resist 15 formed on the secondarily formed protective layer 17R is stripped off to obtain the ink discharge port 6 of the desired shape and to form the ink supply opening 7 (FIG. 9I). In this process, aperture, extending from the ink discharge port 6 to the mold member 14, is formed in the secondarily formed protective layer 17R (discharge port-containing face protective layer to be described later), and in the flow path forming member 4.

Finally, the patterning mask 13 and the protective material (not illustrated) are removed. Thereafter, the mold member 14 is dissolved out and removed from the ink discharge port 6 and the ink supply opening 7 (FIG. 9J).

After the removal of the mold member 14, the ink jet head substrate 1 is dried, thereby completing the process for preparing the ink discharge port 6 and the ink supply opening 7. Thereafter, an electrical connection part, for external electric power supply and for signal exchange for driving the heat generating part 3, is provided to complete the ink jet head.

The ink jet head substrate 1 prepared through the foregoing procedure is different from that in the second exemplary embodiment in that the secondarily formed protective layer 17R itself has a water-repellent property and need not be subjected to a further water-repellent treatment (such as fluorine ion implantation).

In the ink jet head substrate 1 of the present exemplary embodiment, the heat generating part 3, the drive element and wirings therefor, disposed on the surface of the silicon substrate 2 at the lowermost surface of the ink flow path, are covered by an $SiO_2$ layer for protection from the ink. Also an interface between the silicon substrate 2 and the flow path forming member 4 is covered by an interface protective layer 20, formed by the Cat-CVD process. The interface protective layer 20 constitutes a part of the primarily formed protective layer 16. In the adhering surface (adhering portion) between the silicon substrate 2 and the flow path forming member, an adhesion layer 9 and a protective layer formed by the Cat-CVD process may be present. Further, the internal surface (internal wall) of the ink flow path 8, in the interior of the flow path forming member 4, is covered by the flow path internal surface protective layer 19 formed by the Cat-CVD process. The flow path internal surface protective layer 19 is formed by the primarily formed protective layer 16. Also the protective layer of the discharge port-containing face 5 (discharge port-containing face protective layer) is formed by the secondarily formed protective layer 17R having a water-repellent property.

Thus, the protective layer of the discharge port-containing face 5 has a water-repellent property and can suppress an ink deposition on such face, thereby enabling a recording of a high recording quality. Also the protective layer formed by the Cat-CVD process on the internal surface of the ink flow path 8, having a hydrophilic surface, realizes formation of a smooth ink flow thereby enabling a stable bubble formation in the ink and a stable ink discharge. Also the protective layer formed by the Cat-CVD process at the interface between the silicon substrate 2 and the flow path forming member 4 suppresses the contact with the ink and the penetration thereof, thereby contributing to an increased adhesivity of the two.

In the foregoing exemplary embodiment described with reference to FIGS. 9A, 9B, 9C, 9D, 9E, 9F, 9G, 9H, 9I, 9J and 9K, no protective layer is formed on the internal surface of the ink flow path in the discharge part 10 (portion corresponding to the part (2) above). In the following there will be described another producing method, in which a hydrophilic protective film is formed by the Cat-CVD process also in such portion.

Process steps are executed in the same manner as in FIGS. 9A to 9H, and subsequent steps will be described. At first, prepared is a silicon substrate 2 prepared through the steps of FIGS. 9A to 9H and bearing a hydrophilic primarily formed protective layer 16, a water-repellent secondarily formed protective layer 17R and a positive resist 15.

Figure 10A:
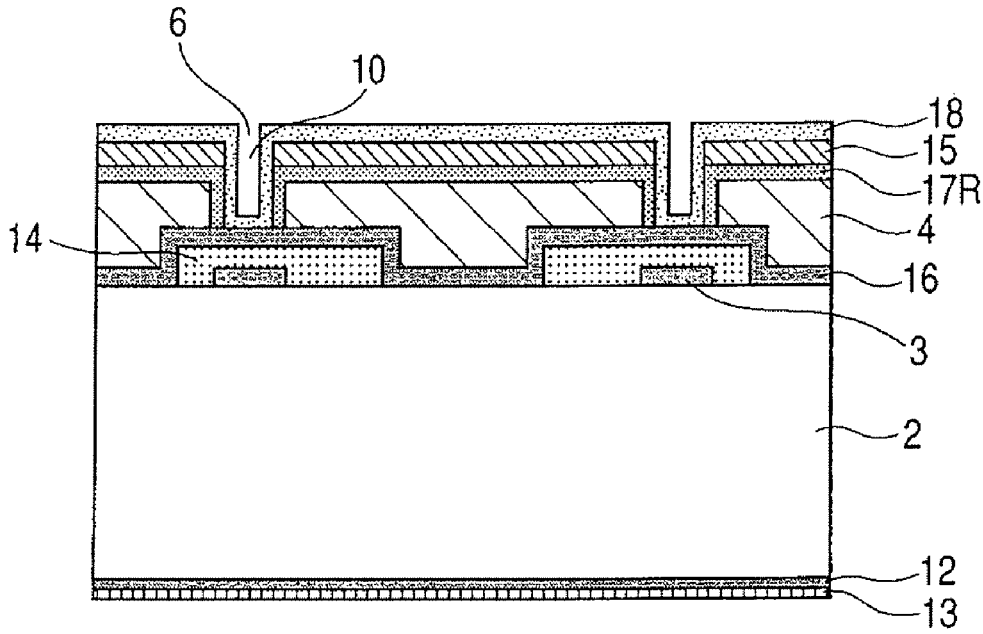
FIGS. 10A and 10B are schematic cross-sectional views illustrating still another producing method for an ink jet head substrate in the third exemplary embodiment of the present invention, wherein 10A and 10B are schematic cross-sectional views illustrating respective steps.

Then a hydrophilic protective layer is formed by the Cat-CVD process, on a mask formed by the secondarily formed protective layer 17R and the positive resist 15 on the discharge port-containing face 5, on the internal surface of the discharge part 10 and on the primarily formed protective layer 16 which is at the bottom of the discharge part 10 and on the mold member 14 (FIG. 10A). The hydrophilic protective layer by the third Cat-CVD process in the present exemplary embodiment is called a tertiary formed protective layer 18. The hydrophilic tertiary formed protective layer 18 may be a SiO layer, a SiN layer or a SiON layer as described above.

Figure 10B:
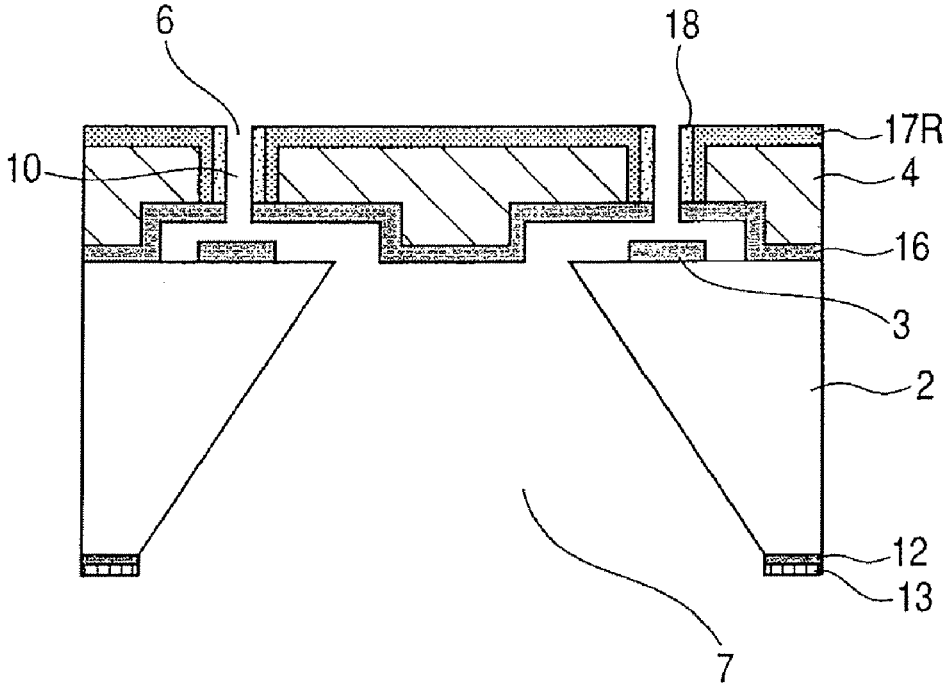

Subsequently, the tertiary formed protective layer 18 on the positive resist 15, and the primarily formed protective layer 16 and the tertiary formed protective layer 18 which are present in the bottom of the discharge part 10 and on the mold member 14 are removed for example by dry etching. In this operation, the dry etching is executed perpendicularly to the opening surface of the ink discharge port 6, so as not to remove the tertiary formed protective layer 18 which is formed on the internal surface of the discharge part 10. Thereafter the positive resist 15 formed on the secondarily formed protective layer 17R is stripped off to obtain the ink discharge port 6 of a desired shape and to form the ink supply opening 7 (FIG. 10B).

Subsequent procedures are same as those described in the foregoing exemplary embodiments.

This producing method enables, in contrast to the ink jet head base member 1 described by FIGS. 9A, 9B, 9C, 9D, 9E, 9F, 9G, 9H, 9I, 9J and 9K, to form a water-repellent protective layer on the discharge port-containing face 5 and to form a hydrophilic protective layer on the internal surface of the discharge part 10. The ink jet head substrate 1 thus prepared has, in addition to the protective layers in the ink jet head substrate 1 obtained by the producing method described by FIGS. 9A, 9B, 9C, 9D, 9E, 9F, 9G, 9H, 9I, 9J and 9K, a tertiary formed protective layer 18 in the internal surface of the flow path in the discharge part 10, as a part of the flow path internal surface protective layer 19.

Therefore, the protection by the hydrophilic protective layer on the internal surface of the ink flow path 8 can be improved, though the manufacturing steps are increased, in comparison with the ink jet head substrate 1 described by FIGS. 9A, 9B, 9C, 9D, 9E, 9F, 9G, 9H, 9I, 9J and 9K.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application Nos. 2006-066346, filed Mar. 10, 2006, 2006-093476, filed Mar. 30, 2006 and 2006-093670 filed Mar. 30, 2006, which are hereby incorporated by reference herein in their entirety.

What is claimed is:

1. A base for a liquid discharge head, comprising:

a base member;

an energy generating element for discharging a liquid, provided on the base member;

a resin structure, including a liquid discharge port for discharging the liquid and a wall of a liquid flow path for supplying the liquid to the liquid discharge port, disposed on the base member so as to contact the base member with the wall in order to cover the energy generating element; and a hydrophilic protective layer formed by a catalytic chemical vapor deposition in a position of the resin structure where a surface constituting the liquid flow path, formed in the interior of the resin structure, comes into contact with the liquid.

2. A base for a liquid discharge head according to claim 1, wherein the hydrophilic protective layer formed by catalytic chemical vapor deposition is provided by stacking atoms or molecules of gas decomposed by a catalytic reaction of a material gas.

3. A base for a liquid discharge head according to claim 1, wherein a surface of the resin structure, which is opposed to a surface in contact with the substrate and on which the discharge port is provided, is provided with an additional protective layer having water-repellent properties.

4. A base for a liquid discharge head according to claim 3, wherein the additional protective layer is formed by the catalytic chemical vapor deposition.

5. A base for a liquid discharge head according to claim 3, wherein the additional protective layer is formed by a material including SiC, SiOC or SiCN as a main component.

6. A base for a liquid discharge head according to claim 3, wherein the additional protective layer is formed by effecting water-repellant treatment to the same material of the hydrophilic protective layer.

7. A base for a liquid discharge head according to claim 6, wherein the water-repellant treatment is performed by injecting fluorine ions in an ion injection method.

8. A base for a liquid discharge head according to claim 1, wherein a surface of the resin structure contacting the base member is provided with an adhesion layer formed by the catalytic chemical vapor deposition.

9. A base for a liquid discharge head according to claim 8, wherein the adhesion layer is made of a material including SiN or SiON as a main component.

10. A base for a liquid discharge head according to claim 1, wherein the protective layer is formed at a temperature not more than a temperature at which the resin structure is deformed.

11. A base for a liquid discharge head according to claim 1, wherein the protective layer is formed at a temperature not more than 200° C.

12. A base for a liquid discharge head according to claim 1, wherein the resin structure is provided by a cured product of epoxy resin or acrylic resin.

13. A base for a liquid discharge head according to claim 1, wherein the hydrophilic protective layer is made of a material including SiN or SiON as a main component.

14. An ink jet head comprising:

a base member for a liquid discharge head according to claim 1; and an electrical connecting portion for applying an electric voltage from an outside to drive the energy generating element.

15. A base for a liquid discharge head, comprising:

a base member;

an energy generating element for discharging a liquid, provided on the base member; and a resin structure, including a liquid discharge port for discharging the liquid and a wall of a liquid flow path for supplying liquid to the liquid discharge port, disposed on the base member so as to contact the base member with the wall in order to cover the energy generating element, wherein a surface of the base member facing the resin structure is provided with an adhesion layer formed by catalytic chemical vapor deposition.

16. A base for a liquid discharge head according to claim 15, wherein the adhesion layer is made of a material including SiN or SiON as a main component.

17. A base for a liquid discharge head, comprising:

a base member;

an energy generating element for discharging a liquid, provided on the base member;

a resin structure, including a liquid discharge port for discharging the liquid and a wall of a liquid flow path for supplying liquid to the liquid discharge port, disposed on the base member so as to contact the base member with the wall in order to cover the energy generating element; and a protective layer formed by a catalytic chemical vapor deposition at a position of the resin structure where a portion of a surface constituting the liquid flow path which is opposed to the base member, and formed in the interior of the resin structure, comes into contact with the liquid.

* * * * *